US009930459B2

(12) United States Patent
Cano et al.

(10) Patent No.: US 9,930,459 B2
(45) Date of Patent: Mar. 27, 2018

(54) HEARING AID WITH DETACHABLE BATTERY COMPARTMENT

(71) Applicant: GN HEARING A/S, Ballerup (DK)

(72) Inventors: Miguel Cano, Chicago, IL (US); Greg Olsen, Glenview, IL (US); Shira Hahn, Glenview, IL (US); Alex Kuvshinkov, Glenview, IL (US)

(73) Assignee: GN Hearing A/S, Ballerup (DK)

( * ) Notice: Subject to any disclaimer, the term of this patent is extended or adjusted under 35 U.S.C. 154(b) by 42 days.

(21) Appl. No.: 14/339,701

(22) Filed: Jul. 24, 2014

(65) Prior Publication Data

US 2016/0029133 A1 Jan. 28, 2016

(51) Int. Cl.
*H04R 25/00* (2006.01)

(52) U.S. Cl.
CPC ..... *H04R 25/602* (2013.01)

(58) Field of Classification Search
CPC H04R 25/602; H04R 25/65; H04R 2225/021; H04R 2225/31; H04R 2225/61; H04R 2225/63; H04R 25/554; H04R 25/556; H04R 25/60; H04R 25/608; H04R 25/75; H04R 1/10; H04R 2201/10; H04R 2225/023; H04R 2225/49; H04R 2460/03; H04R 2460/17; H04R 25/00
USPC ..... 381/323, 322, 314, 324
See application file for complete search history.

(56) References Cited

U.S. PATENT DOCUMENTS

| | | | | |
|---|---|---|---|---|
| 6,041,128 | A * | 3/2000 | Narisawa | H04R 25/602 381/322 |
| 6,731,770 | B1 * | 5/2004 | Vonlanthen | H04R 25/556 381/314 |
| 7,016,512 | B1 * | 3/2006 | Feeley | H04R 25/608 381/322 |
| 7,110,562 | B1 * | 9/2006 | Feeley | 381/322 |
| 7,123,733 | B1 * | 10/2006 | Borowsky | H04R 25/652 381/322 |
| 8,103,032 | B2 * | 1/2012 | Ho | H04R 25/602 381/322 |
| 2013/0243229 | A1 * | 9/2013 | Shennib | H04R 25/602 381/323 |
| 2014/0254843 | A1 * | 9/2014 | Shennib | H04R 25/608 381/323 |
| 2014/0254844 | A1 * | 9/2014 | Shennib | H04R 25/556 381/323 |
| 2014/0254845 | A1 * | 9/2014 | Hastrup | H04R 25/556 381/323 |

* cited by examiner

*Primary Examiner* — Davetta W Goins
*Assistant Examiner* — Phylesha Dabney
(74) *Attorney, Agent, or Firm* — Vista IP Law Group, LLP

(57) ABSTRACT

A kit-of-parts includes: a hearing aid having a first attachment member; a first device comprising a second attachment member that is configured to mate with the first attachment member of the hearing aid; and a second device comprising a third attachment member that is configured to mate with the first attachment member of the hearing aid; wherein the second attachment member and the third attachment are alternatively attachable to the first attachment member of the hearing aid; and wherein the first device comprises a first electrical power source that is rechargeable, and the second device comprises an accessible compartment configured for holding a second electrical power source.

21 Claims, 5 Drawing Sheets

HEARING AID WITH DETACHABLE BATTERY COMPARTMENT

FIELD

This disclosure relates to hearing aid systems. More specifically, it relates to battery-powered hearing aids adapted for being powered by a variety of power sources. The disclosure further relates to a hearing aid.

BACKGROUND

Batteries for hearing aids need to be small in order to fit within the strictly restricted space of a hearing aid housing. Contemporary hearing aids may be powered by a variety of different power sources including, but not limited to, zinc-air batteries, lithium-ion batteries, lithium-polymer batteries and similar compact power sources. Some battery types are disposable, such as zinc-air batteries, while other battery types, such as the lithium-ion or lithium-polymer battery types, are rechargeable. Changing or recharging batteries presents a challenge to a disabled or elderly person due to the small size of the batteries and the motor skills required of the person changing the batteries.

Systems for charging hearing aid batteries while the batteries reside in the hearing aids have been devised, thus eliminating the need for changing batteries. However, the rechargeable batteries of these systems are usually hard-wired into the hearing aids without a possibility for exchanging the battery. This leaves the user with a hearing aid having a useful service life equal to that of the battery itself, e.g. three to four years, leaving the user with no other option but to purchase a new hearing aid once the rechargeable battery is depleted. Since a hearing aid may function reliably for as long as ten years if provided with proper maintenance, this may pose an undue economical burden upon the hearing aid user.

SUMMARY

Thus, a hearing aid system providing the user with an easier means of changing the hearing aid battery regardless of the battery type may be desirable. A hearing aid system allowing interchanging disposable batteries for rechargeable batteries may also be appreciated.

According to a first aspect a kit-of-parts is devised, said kit comprising a hearing aid having a first attachment member, a first device comprising a second attachment member matingly attachable to the first attachment member of the hearing aid, and a second device comprising a third attachment member matingly attachable to the first attachment member of the hearing aid, wherein the first device comprises a first, rechargeable electrical power source and the second device comprises an accessible compartment configured for holding a second, exchangeable electrical power source.

By having the power source mounted in a device separate from the hearing aid housing it becomes possible to provide a multitude of ways for attaching the device comprising the power source to the hearing aid housing. The attachment means may then be embodied in one of several ways making it very easy for a disabled person to change the battery while maintaining a firm and secure electrical connection between the two parts when the device containing the battery is attached to the hearing aid housing.

In one embodiment, the first attachment member of the hearing aid is a female bayonet plug, and the second and the third attachment members are male bayonet plugs configured for engaging in mating connection with the female bayonet plug of the hearing aid.

This feature allows the power source to be detached from the hearing aid by a user performing a twisting clockwise or anti-clockwise action on the power source followed by a pulling action. Studies have shown these actions to be less demanding on the fine motor skills of e.g. a disabled or elderly person. The bayonet plugs may preferably exhibit an easily perceptible locking action, such as a 'clicking' action, enabling the user to determine the engagement between the male and the female bayonet plug.

According to a second aspect, a hearing aid is devised, said hearing aid having an electrical connector for connecting an external device comprising a first electrical power source, wherein the hearing aid is powered by the first electrical power source when the external device is connected to the hearing aid. The electrical connector in the hearing aid provides a flexible, detachable means of providing power to the hearing aid which is easy to handle, e.g. by a physically disabled individual. The detachable, external device may comprise a disposable battery or a rechargeable battery.

In one embodiment, the hearing aid comprises a second, internal, rechargeable, electrical power source and a charging circuit permanently connected to the second internal, rechargeable, electrical power source. This feature enables the hearing aid to be powered by the internal power source when the external device is disconnected from the hearing aid. In one scenario, the hearing aid may draw its power from the internal, rechargeable power source for an additional period of use, e.g. whenever the power source of the external device is depleted, allowing the user of the hearing aid to benefit from the hearing aid for a prolonged period of time without worrying about the hearing aid running out of power. An additional benefit is the fact that the internal, rechargeable battery will last longer, thus providing the hearing aid with a prolonged service life.

Further features and embodiments are evident from the dependent claims.

A kit-of-parts includes: a hearing aid having a first attachment member; a first device comprising a second attachment member that is configured to mate with the first attachment member of the hearing aid; and a second device comprising a third attachment member that is configured to mate with the first attachment member of the hearing aid; wherein the second attachment member and the third attachment are alternatively attachable to the first attachment member of the hearing aid; and wherein the first device comprises a first electrical power source that is rechargeable, and the second device comprises an accessible compartment configured for holding a second electrical power source.

Optionally, the first attachment member is configured to make an electrical connection with the first device via the second attachment member.

Optionally, the first attachment member is configured to make an electrical connection with the second device via the third attachment member.

Optionally, the hearing aid is powered by the first electrical power source when the first device is attached to the hearing aid.

Optionally, the hearing aid is powered by the second electrical power source when the second device is attached to the hearing aid.

Optionally, the first attachment member of the hearing aid comprises a female bayonet plug.

Optionally, the second attachment member comprises a first male bayonet plug configured to connect with the female bayonet plug when the second attachment member is attached to the first attachment member; and the third attachment member comprises a second male bayonet plug configured to connect with the female bayonet plug when the third attachment member is attached to the first attachment member.

Optionally, the second attachment member is configured for interlocking connection with the first attachment member of the hearing aid; and the third attachment member is configured for interlocking connection with the first attachment member of the hearing aid.

Optionally, the first electrical power source of the first device comprises a rechargeable battery.

Optionally, the first electrical power source of the first device comprises a solar battery.

Optionally, the second electrical power source comprises an exchangeable battery, and the accessible compartment of the second device is configured for holding the exchangeable battery.

Optionally, the exchangeable battery comprises a disposable zinc-air battery.

Optionally, the exchangeable battery comprises a fuel cell.

A hearing aid includes: an electrical connector for connecting an external device comprising a first electrical power source to the hearing aid; wherein the hearing aid is powered by the first electrical power source when the external device is connected to the hearing aid.

Optionally, the electrical connector of the hearing aid is configured for locking engagement with a mating electrical connector of the external device when the external device is connected to the hearing aid.

Optionally, the hearing aid comprises a second electrical power source and a circuit electrically connectable to the second electrical power source, and wherein the second electrical power source is rechargeable and is located inside the hearing aid.

Optionally, the second electrical power source is electrically disconnected from the circuit when the external device is connected to the hearing aid.

Optionally, the second electrical power source is electrically connected to the circuit when the external device is disconnected from the hearing aid.

Optionally, the circuit is configured to obtain electrical power for charging the second electrical power source from a power source connected to the electrical connector of the hearing aid.

Optionally, the circuit is configured to obtain electrical power for charging the second electrical power source from an inductive coil in the hearing aid, in response to an interaction between the coil in the hearing aid and an inductive charging device located outside the hearing aid.

Other and further aspects and features will be evident from reading the following detailed description of the embodiments.

BRIEF DESCRIPTION OF THE FIGURES

The embodiments will now be disclosed in greater detail with respect to the drawings, where.

DETAIL DESCRIPTION

Figure 1:
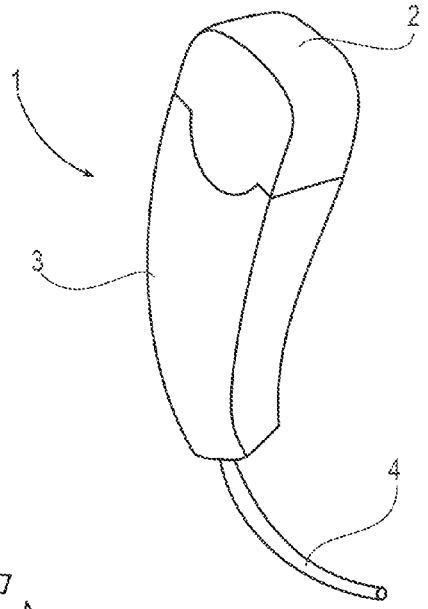
FIG. 1 illustrates an embodiment of a hearing system comprising a detachable power source.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 shows part of a hearing aid system 1 according to some embodiments. The hearing aid system 1 comprises a hearing aid housing 3, a power source 2 and a sound tube 4. During use, the sound tube 4 is connected to an otoplastic plug with a sound outlet or a hearing aid telephone (not shown in FIG. 1). The power source 2 is connected to the hearing aid housing 3 by a bayonet plug (not shown in FIG. 1) for easy detachment and insertion by a hearing aid user.

Figure 2:
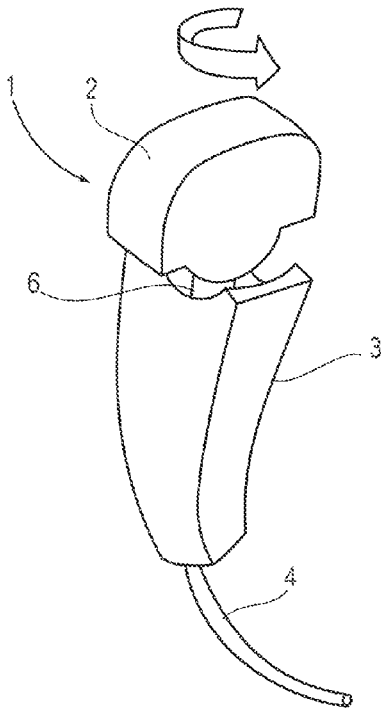
FIG. 2 illustrates the embodiment of the hearing system in FIG. 1 with the power source in a semi-detached position.

FIG. 2 shows the twisting motion part of the manual operation performed to separate the power source 2 from the hearing aid housing 3. When the twisting motion is performed, a bayonet male plug 5 is revealed between the hearing aid housing 3 and the power source 2. The bayonet male plug 5 is adapted for mating connection with a corresponding female bayonet plug (not shown in FIG. 2) for providing electrical connections between the power source 2 and the hearing aid housing 3 for the purpose of supplying the hearing aid circuitry (not shown) within the hearing aid housing 3 with electrical power.

Figure 3:
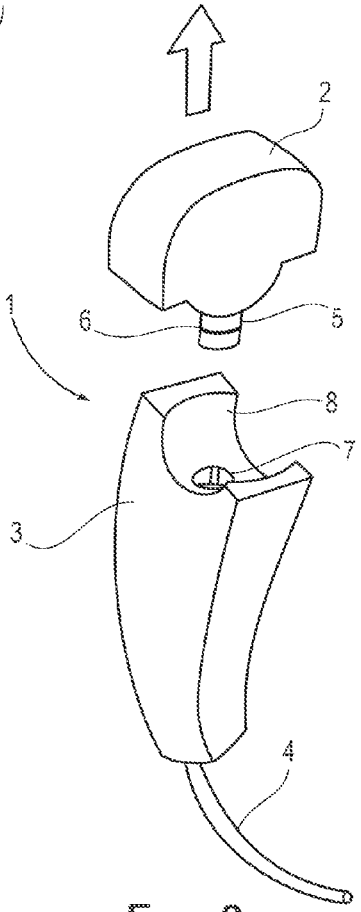
FIG. 3 illustrates the embodiment of the hearing system in FIG. 1 with the power source in a fully detached position.

FIG. 3 shows the pulling motion part of the manual operation performed to separate the power source 2 from the hearing aid housing 3, thereby revealing a female bayonet receptacle 7 embodied in the hearing aid housing 3 and configured for mating connection with the bayonet male plug 5 of the power source 2. A groove 6 is provided in the male bayonet plug 5 for engaging a bayonet locking mechanism (not shown) in the female bayonet receptacle 7. In order to facilitate insertion and rotation of the male bayonet plug 5 into the female bayonet receptacle 7 in order to interlock the power source 2 and the hearing aid housing 3, a hemispherical depression 8 is provided in the hearing aid housing 3 centred on the female bayonet receptacle 7.

The hemispherical depression 8 is configured to engage with a similarly shaped hemispherical protrusion in the power source 2 from the centre of which the male bayonet plug 5 protrudes along a length axis of the power source 2. The hemispherical protrusion of the power source 2 and the hemispherical depression 8 of the hearing aid housing 3 allows for a turning action to be performed on the power source when it is inserted in the hearing aid housing 3. When the power source 2 is twisted counter clockwise by e.g. 90° about its length axis with respect to the hearing aid housing, the locking mechanism 6 of the bayonet plug 5 and the corresponding locking mechanism (not shown) of the bayonet receptacle 7 of the hearing aid housing 3 is disengaged, allowing for removal of the power source 2 from the hearing aid housing 3. Similarly, the power source 2 may be connected to the hearing aid housing by inserting the bayonet plug 5 of the power source 2 into the bayonet receptacle 7 of the hearing aid housing 3 and twisting the power source 2 clockwise by e.g. 90°, thus interlocking the bayonet plug 5 of the power source 2 with the bayonet receptacle 7 of the hearing aid housing 3, the hemispherical depression 8 of the hearing aid housing 3 and the hemispherical protrusion of the power source 2 forming a seal between the power source 2 and the hearing aid housing 3, and the bayonet plug 5 of the power source 2 and the bayonet receptacle 7 of the hearing aid housing 3 forming an electrical connection between the power source 2 and the hearing aid circuitry (not shown).

Figure 4:
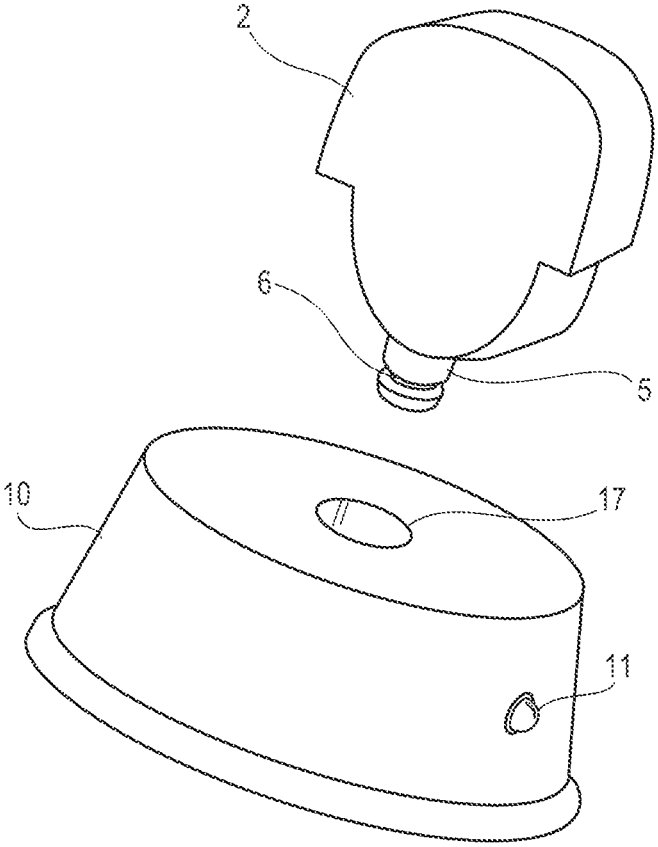
FIG. 4 illustrates the embodiment of the power source of FIG. 1 together with a mating recharging device.

FIG. 4 shows the power source 2 with a charging device 10. The charging device 10 has an indicator light 11 and a female bayonet receptacle 17 for mating connection of a male bayonet plug. The embodiment of the power source 2 shown in FIG. 4 is configured for recharging, comprising e.g. a rechargeable battery such as a lithium-ion battery, a lithium-polymer battery or the like. The power source 2 is intended to power a hearing aid. Whenever the rechargeable battery is depleted, the power source 2 is detached from the hearing aid in the manner shown in FIGS. 1-3 and placed in the charging device 10 by plugging the male bayonet plug 5 of the power source 2 into the female bayonet receptacle 17 of the charging device 10 and twisting the power source 2 about the length axis of the male bayonet plug 5, locking the power source 2 in place in the charging device 10.

During the charging process, the indicator light 11 of the charging device 10 may indicate how the charging progresses, e.g. having the indicator light 11 turned on when charging is initiated and turned off when the rechargeable battery of the power source 2 is fully charged. The presence of the power source 2 in the charging device 10 may be detected by the circuitry of the charging device 10 in a simple and easy manner, e.g. by measuring the current provided by the power source 2. This feature eliminates the need for any user operable switches on the surface of the charging device 10, since the charging process initiates automatically when a power source 2 is properly inserted into the charging device, and terminates when the rechargeable battery of the power source 2 is fully recharged, the charging device 10 providing only a trickle charge to the rechargeable battery until the power source 2 is removed from the charging device 10.

Figure 5:
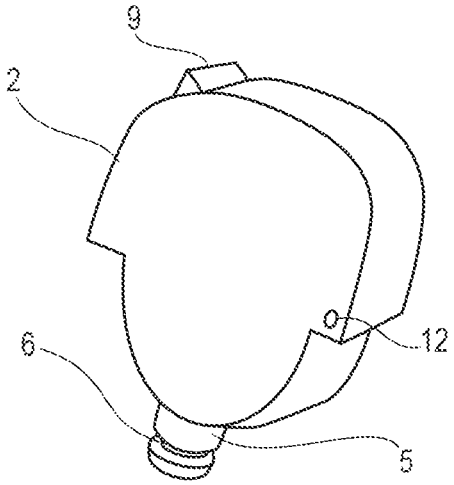
FIG. 5 illustrates an alternative embodiment of a power source for a hearing aid with a hinged battery compartment.

FIG. 5 shows an embodiment of a power source 2 for a hearing aid. The battery of the power source 2 is not intended for recharging by a user but instead adapted for receiving e.g. a zinc-air battery for powering the hearing aid. In the embodiment of the power source 2 shown in FIG. 5, a protrusion enables access to a battery compartment of the power source 2 by swinging a battery compartment lid about a pivot 12, thus opening the battery compartment of the power source 2. The opening mechanism of the battery compartment of the embodiment of the power source 2 in FIG. 5 is described in greater detail in FIGS. 6, 7, and 8.

Figure 6:
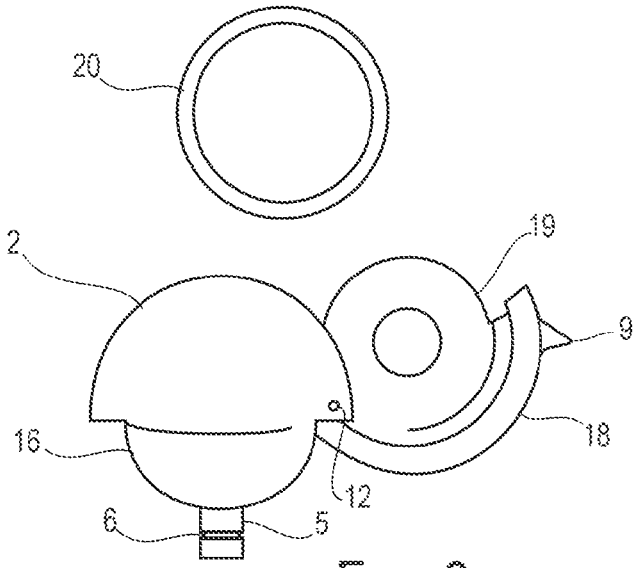
FIG. 6 illustrates the embodiment of the power source of FIG. 5 in an open position.
Figure 7:
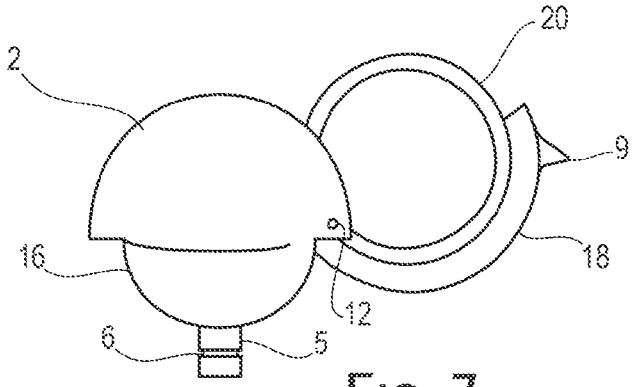
FIG. 7 illustrates the embodiment of the power source of FIG. 5 in an open position with a battery mounted.
Figure 8:
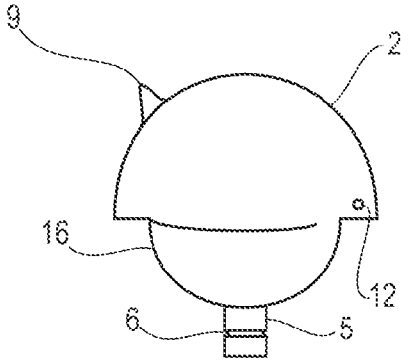
FIG. 8 illustrates the embodiment of the power source of FIG. 5 in a closed position.

FIGS. 6, 7 and 8 illustrates the steps of placing a battery 20 in a battery compartment in the embodiment of the power source 2 as shown in FIG. 5. In FIG. 6, the battery 20 is shown outside the battery compartment of the power source 2. The battery compartment is enclosed by a battery compartment lid 18 and a battery compartment bottom 19. The battery compartment opening tab 9 protrudes from the curved surface of the battery compartment lid 18 in order to facilitate easy opening and closing of the battery compartment. The battery compartment is adapted to swing about the battery compartment pivot 12. When the battery 20 is placed in the battery compartment of the power source 2 the rim of the battery 20 abuts the inner surface of the battery compartment lid 18 in the manner shown in FIG. 7. When the battery compartment lid 18 is closed, as shown in FIG. 8, the battery terminals connect with contact springs (not shown) embedded in the power source 2, and the power source 2 is ready for attachment to a hearing aid (not shown).

Figure 9:
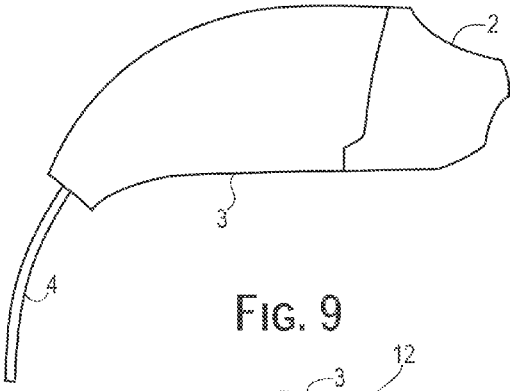
FIG. 9 illustrates an alternative embodiment of a hearing system comprising a detachable power source.
Figure 10:
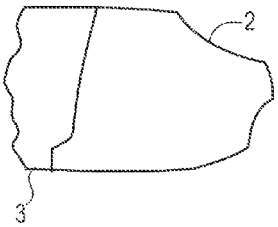
FIG. 10 illustrates a detail of the embodiment in FIG. 9 with a larger power source.
Figure 11:
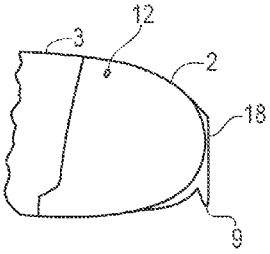
FIG. 11 illustrates a detail of the embodiment in FIG. 9 with a power source comprising a battery compartment in a closed position.
Figure 12:
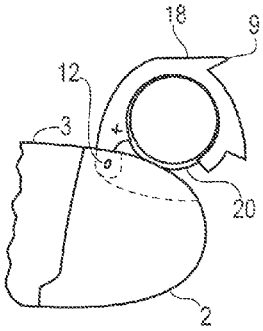
FIG. 12 illustrates the power source in FIG. 11 with the battery compartment in an open position.

FIGS. 9, 10, 11 and 12 illustrates an alternative embodiment of a hearing aid system having a detachable power source. FIG. 9 shows an embodiment of a hearing aid 3 having a detachable power source 2 adapted for comprising a small, rechargeable battery. FIG. 10 shows part of a similar hearing aid 3 having a detachable power source 2 adapted for comprising a larger rechargeable battery, e.g. intended for a high power hearing aid. FIG. 11 shows part of a similar hearing aid 3 having a detachable power source 2 adapted for comprising an exchangeable battery. The detachable power source 2 shown in FIG. 11 has a battery compartment 18 lid for accessing and exchanging the battery of the power source 2. The battery compartment 18 lid may be opened by a user by engaging the battery compartment opening tab 9. FIG. 12 shows part of the hearing aid 3 of FIG. 11 with the battery compartment lid 18 in an open position, exposing the battery 20. The battery compartment lid 18 may be opened by turning the battery compartment about the pivot 12 by engaging the battery compartment opening tab 9 in a manner similar to the power source shown in FIGS. 6, 7 and 8.

Figure 13:
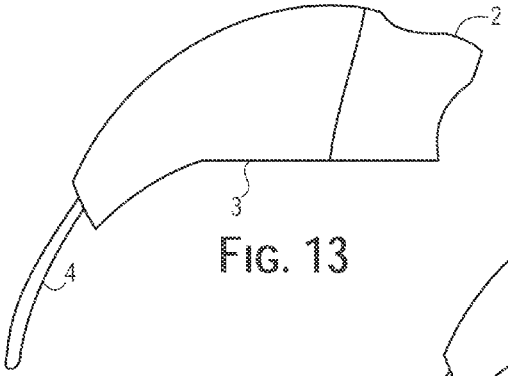
FIG. 13 illustrates another alternative embodiment of a hearing system comprising a detachable power source.
Figure 14:
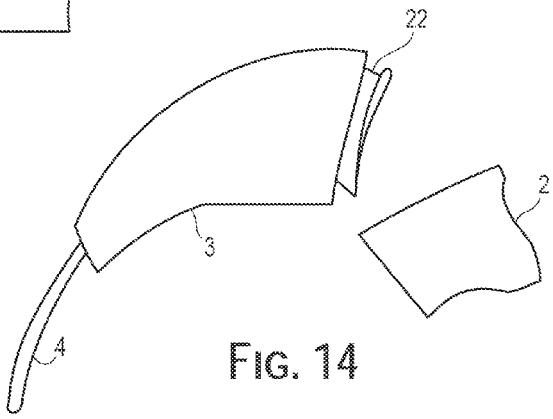
FIG. 14 illustrates the embodiment in FIG. 13 with the power source detached.

FIGS. 13 and 14 illustrates another alternative embodiment of a hearing aid system having a detachable power source. In FIG. 13, the embodiment of the hearing aid 3 has a power source 2 attached to the hearing aid 3. In FIG. 14, the power source 2 is detached from the hearing aid 3 exposing a locking engaging member 22 of the hearing aid 3. In the embodiment shown in FIG. 14, the locking engaging member 22 is shown as a siding engaging member, but the skilled person would readily appreciate that the locking engaging member 22 of the hearing aid 3 may be embodied as e.g. a pivoted member provided that the power source 2 may be easily and securely attached to the hearing aid 3 without the risk of the power source 2 becoming detached during use.

Figure 15:
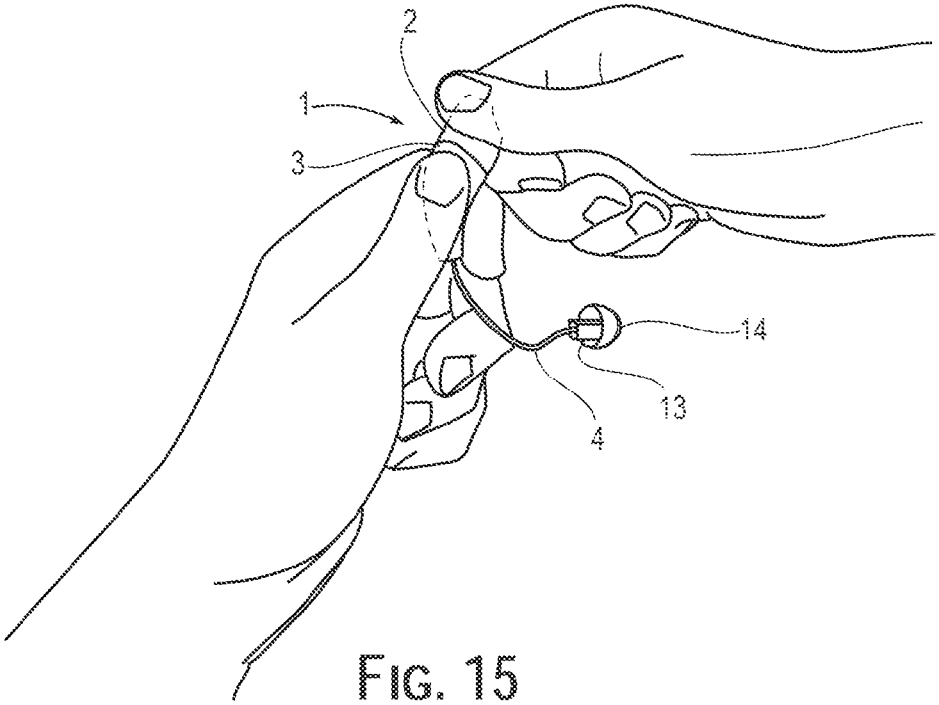
FIGS. 15 and 16 illustrate how a power source may be detached from the hearing aid housing.
Figure 16:
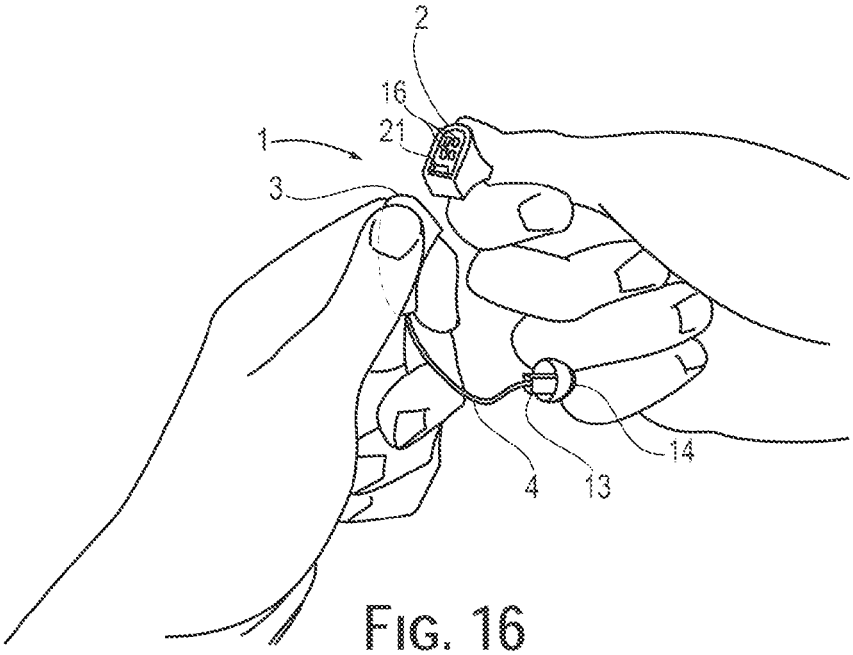

FIGS. 15 and 16 illustrates how the power source 2 may be detached from the hearing aid 3 in a simple, secure and convenient manner. The hearing aid system 1 is held in the hands of a user in the manner shown in FIG. 15, where the hearing aid 3 is held in the left hand and the power source 2 is held in the right hand in a precision grip. Also shown in FIG. 15 is the sound tube 4, a receiver-in-ear (RIE) telephone 13 and a fitting dome 14 for fitting the hearing aid in the ear. By pulling the power source 2 gently towards oneself while holding the hearing aid 3 in this manner, the power source 2 may be detached from the hearing aid 3 as shown in FIG. 16, exposing a locking engaging member 22 and electrical terminals 16 of the power source 2.

Although particular embodiments have been shown and described, it will be understood that they are not intended to limit the claimed inventions, and it will be obvious to those skilled in the art that various changes and modifications may be made without departing from the scope of the claimed inventions. The specification and drawings are, accordingly, to be regarded in an illustrative rather than restrictive sense. The claimed inventions are intended to cover alternatives, modifications, and equivalents.

The invention claimed is:

1. A kit-of-parts comprising:

a first attachment member of a hearing aid;

a first device comprising a second attachment member that is configured to mate with the first attachment member of the hearing aid; and a second device comprising a third attachment member that is configured to mate with the first attachment member of the hearing aid;

wherein the second attachment member and the third attachment are alternatively attachable to the first attachment member of the hearing aid;

wherein the first device comprises a first electrical power source (1) that is rechargeable when the first device is detached from the hearing aid, and (2) that is configured to power the hearing aid when the first device is attached to the hearing aid, and the second device comprises an accessible compartment configured for holding a second electrical power source that is configured to power the hearing aid; and wherein the second attachment member comprises an electrical contact configured (1) to engage with a first electrical terminal at the hearing aid, and (2) also to alternatively engage with a second terminal at a charging device when the electrical contact is not engaged with the first electrical terminal at the hearing aid.

2. The kit-of-parts according to claim 1, wherein the first attachment member is configured to make an electrical connection with the first device via the second attachment member.

3. The kit-of-parts according to claim 1, wherein the first attachment member is configured to make an electrical connection with the second device via the third attachment member.

4. The kit-of-parts according to claim 1, wherein the hearing aid is powered by the first electrical power source when the first device is attached to the hearing aid.

5. The kit-of-parts according to claim 1, wherein the hearing aid is powered by the second electrical power source when the second device is attached to the hearing aid.

6. The kit-of-parts according to claim 1, wherein the first attachment member of the hearing aid comprises a female bayonet plug.

7. The kit-of-parts according to claim 1, wherein:

the second attachment member is configured for interlocking connection with the first attachment member of the hearing aid; and the third attachment member is configured for interlocking connection with the first attachment member of the hearing aid.

8. The kit-of-parts according to claim 1, wherein the first electrical power source of the first device comprises a rechargeable battery.

9. The kit-of-parts according to claim 1, wherein the first electrical power source of the first device comprises a solar battery.

10. The kit-of-parts according to claim 1, wherein the second electrical power source comprises an exchangeable battery, and the accessible compartment of the second device is configured for holding the exchangeable battery.

11. The kit-of-parts according to claim 10, wherein the exchangeable battery comprises a disposable zinc-air battery.

12. The kit-of-parts according to claim 10, wherein the exchangeable battery comprises a fuel cell.

13. The kit-of-parts of claim 1, wherein the first device comprises a housing for accommodating the first electrical power source, and wherein a majority of the housing is external to the hearing aid when the first device is coupled with the hearing aid.

14. The kit-of parts-of claim 1, wherein the first electrical power source is outside a housing of the hearing aid.

15. A kit-of-parts comprising:

a first attachment member of a hearing aid;

a first device comprising a second attachment member that is configured to mate with the first attachment member of the hearing aid; and a second device comprising a third attachment member that is configured to mate with the first attachment member of the hearing aid;

wherein the second attachment member and the third attachment are alternatively attachable to the first attachment member of the hearing aid;

wherein the first device comprises a first electrical power source that is rechargeable, and the second device comprises an accessible compartment configured for holding a second electrical power source;

wherein the first device comprises a housing for accommodating the first electrical power source; and wherein the second attachment member comprises an electrical contact configured (1) to engage with a first electrical terminal at the hearing aid, and (2) also to alternatively engage with a second terminal at a charging device when the electrical contact is not engaged with the first electrical terminal at the hearing aid.

16. The kit-of-parts of claim 15, wherein the first attachment member of the hearing aid comprises a female bayonet plug;

wherein the second attachment member comprises a first male bayonet plug configured to connect with the female bayonet plug when the second attachment member is attached to the first attachment member; and wherein the third attachment member comprises a second male bayonet plug configured to connect with the female bayonet plug when the third attachment member is attached to the first attachment member.

17. The kit-of-parts according to claim 15, wherein the first electrical power source of the first device comprises a rechargeable battery.

18. The kit-of-parts according to claim 15, wherein the first electrical power source of the first device comprises a solar battery.

19. The kit-of-parts according to claim 15, wherein the second electrical power source comprises an exchangeable battery, and the accessible compartment of the second device is configured for holding the exchangeable battery.

20. The kit-of-parts according to claim 19, wherein the exchangeable battery comprises a disposable zinc-air battery.

21. The kit-of-parts according to claim 19, wherein the exchangeable battery comprises a fuel cell.

* * * * *